US006267568B1

(12) United States Patent
Pagnon et al.

(10) Patent No.: US 6,267,568 B1
(45) Date of Patent: Jul. 31, 2001

(54) DIAPHRAGM PUMP

(75) Inventors: Alain Pagnon, Valence; Jean Denis Garcin, Drone, both of (FR)

(73) Assignee: Imaje S.A., Bourg les Valence Cedex (FR)

( * ) Notice: Subject to any disclaimer, the term of this patent is extended or adjusted under 35 U.S.C. 154(b) by 0 days.

(21) Appl. No.: 09/334,798

(22) Filed: Jun. 16, 1999

(30) Foreign Application Priority Data

Jun. 29, 1998 (FR) ..... 98 08224

(51) Int. Cl.[7] ..... F04B 17/00
(52) U.S. Cl. ..... 417/403
(58) Field of Search ..... 417/385, 395, 417/403; 347/85

(56) References Cited

U.S. PATENT DOCUMENTS 3,387,566 6/1968 Temple .
3,781,141 12/1973 Schall .
4,003,679 * 1/1977 McManigill ..... 417/385
4,068,983 1/1978 Balme et al. .
4,372,208 2/1983 Legardinier .
4,648,810 * 3/1987 Schippers et al. ..... 417/395
5,782,617 7/1998 Habla .

FOREIGN PATENT DOCUMENTS 758 053 A1 2/1997 (EP) .
2 466 640 4/1981 (FR) .

OTHER PUBLICATIONS

Granger Catalog Jan. 1991.*

* cited by examiner

*Primary Examiner*—Timothy S. Thorpe
*Assistant Examiner*—W. Rodriguez
(74) *Attorney, Agent, or Firm*—Pearne & Gordon LLP

(57) ABSTRACT

The present invention relates to a diaphragm pump comprising an entirely pneumatic control mechanism, which has a double acting jack (18), to which is connected a diaphragm (19), delivery being obtained by the pressurizing of several chambers (15, 16, 17), admission being obtained by the preparation of a first chamber (15), the other chambers (16, 17) being under atmospheric pressure.

9 Claims, 5 Drawing Sheets

DIAPHRAGM PUMP

TECHNICAL FIELD

The present invention relates to a diaphragm pump.

PRIOR ART

A prior art document, U.S. Pat. No. 4,862,192, describes an ink jet point printer, with an ink circuit comprising a transfer device for transferring thick ink from a first supply tank and, independently thereof, the additive from a second supply tank, into an ink chamber. Ink from said ink chamber is supplied under pressure to a writing head. Ink is returned to the ink chamber through a recovery channel, traversing the writing head and recovering the ink droplets which have not been deflected for writing requirements. The transfer device uses pressurized air for transporting the ink between an ink tank, connected to the writing head, a mixing tank, connected to the supply tanks, and a recovery tank, connected to the recovery channel. The mixing tank can be alternatively connected to a suction line or to a delivery line.

In this prior art printer, the ink transfer is consequently ensured by an intermediate tank which is either under vacuum for recovering the ink in the recovery tank, or under pressure during the supply phase of the tank (accumulator) connected to the print head. FIG. 1 shows the diagram of such a printer. The presence of an intermediate volume therein is a source of problems. Thus, the dimensions of said volume are by no means negligible. The volume and air/ink exchange surface lead to:

- a high air consumption due to successive inflations and deflations of said intermediate volume,
- a dissolving of the air in the ink, because the mixing volume is not equipped with an air/ink separator,
- an overdimensioning and an increase in the number of pneumatic components (three pressure regulators, two and three-way valves, etc.).

These different problems lead to the use on said machines of a system differing from that described hereinbefore. Thus, on the marketed machines, it can be seen that the:

- the ink transfer takes place with a diaphragm pump located between the mixing tank and the accumulator,
- the mixing tank is permanently under vacuum and in fact becomes the recovery tank, which disappears from the primary circuit.

FIG. 2 shows a diagram of the system equipping the machines. This system, which is simpler and better adapted to an ink jet printer, uses a diaphragm pump. For this novel circuit, liquid admission is ensured by a spring integrated into a pump, which is directly immersed in the ink. The spring requires guiding and centring operations, which significantly increase its size. The displacement of such a pump is significant and requires the presence of a precise, mechanical air pressure regulator on the accumulator or storage tank. As the internal volume of the pump is significant, such a system suffers from numerous disadvantages during a rapid ink colour change (there is a large surface to be cleaned). This prior art printer does not bidirectionally use the pump, although there are suction valves and sometimes outlet valves with the pumps. The principle of this prior art printer is simple, but limited with respect to future applications (control of transferred volumes, ease of machine rinsing, colour change, ink addition and additive addition by the pump). It should be noted that on said machine, the pump only has a very limited number of functionalities.

The invention relates to a diaphragm pump making it possible to obviate these disadvantages.

DESCRIPTION OF THE INVENTION

The present invention describes a diaphragm pump incorporating an entirely pneumatic control mechanism, which has a double acting jack, to which is connected a diaphragm, delivery being obtained by the pressurizing of several chambers and admission being obtained by the pressurizing of a first chamber, the other chambers being under atmospheric pressure.

Advantageously, the control of said diaphragm pump is brought about by means of a single two-way/two-position solenoid valve completed by the presence of a gauged orifice permitting the depressurization of the chambers. Advantageously, said diaphragm pump comprises a body from which are hollowed out two cavities and communication channels, a two-part control piston, the diaphragm being integral with the first of the two parts of the piston. It also comprises two joints or seals located between the body and the piston, one being integral with the body (rod seal) and the other integral with the second part of the piston (piston seal). The positioning of the piston equipped with the diaphragm within these two cavities makes it possible to obtain a large chamber in two isobaric parts, a small chamber, as well as an access chamber to which access is respectively given by different orifices and in particular two suction/delivery orifices.

The pump according to the invention no longer requires the use of a spring for pump return purposes, as was the case in the prior art document. The spring is in fact a mechanical component to be calibrated, which is subject to variations in its characteristics. The spring must not be too strong to in all cases permit the delivery control and sufficiently strong to permit in all cases the suction control. This difficulty of adapting said component to the operating conditions does not exist with the pump according to the invention. Thus, the pump according to the invention adapts to all operating pressure evolutions. Thus, such a pump has a high vacuum capacity independent of its pressure characteristics. Thus, the stress or load used for creating the vacuum is directly associated with the product of the pressure prevailing in the small chamber of the jack multiplied by the surface of said small chamber. The maximum vacuum possible is obtained by dividing the load by the surface of the diaphragm. The pressure in the small chamber is permanently the source pressure, so that we obtain:

maximum vacuum=source pressure*(small chamber section/diaphragm section).

The load used for creating the pressure is directly associated with the product of the pressure prevailing in the large chamber of the jack multiplied by the surface of the diaphragm. The maximum possible delivery pressure with such a pump is consequently the source pressure.

If S is the surface of the large chamber, s the surface of the small chamber and S diaphragm the surface of the diaphragm. The arrangement is diagrammatically shown in FIG. 3. During delivery, the driving pressure is applied to (S diaphragm−s rod+S) and substantially the same pressure is applied to s. It is pointed out that: S rod=S−s and consequently:

delivery load=pressure*((S diaphragm−(S−s)+S)−s), i.e.:
delivery load=pressure*S diaphragm.

The delivery driving load is independent of the section of the small chamber of the jack.

Advantageously, the diaphragm pump according to the invention is equipped with a pressure and temperature sensor, which is in direct contact with the fluid inside the pump.

The invention also relates to a hydraulic circuit equipped with said pump.

Advantageously, the latter comprises:

means for monitoring the source pressure located at the regulator outlet, means for determining the clogging of a filter located in its delivery, means for checking the sealing of the ink circuit components, means for implementing the flowmeter functionality of the different fluid quantities consumed.

The invention also relates to an ink jet printer equipped with said ink circuit.

The pump according to the invention has numerous advantages:

simplicity, small number of parts, very small dead spaces, operating reliability.

DETAILED DESCRIPTION OF EMBODIMENTS

Figure 1:
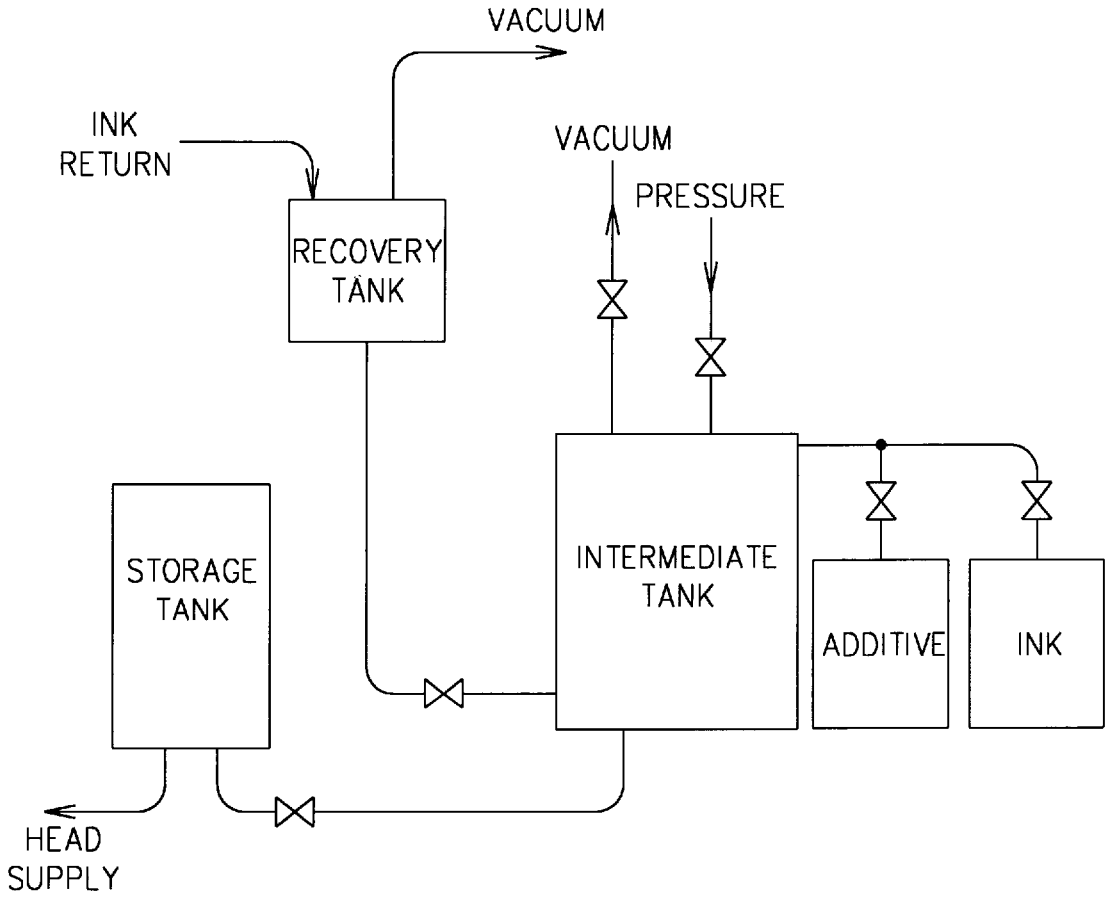
FIG. 1 PRIOR ART
FIGS. 1 and 2 show two embodiments of prior art devices.
Figure 2:
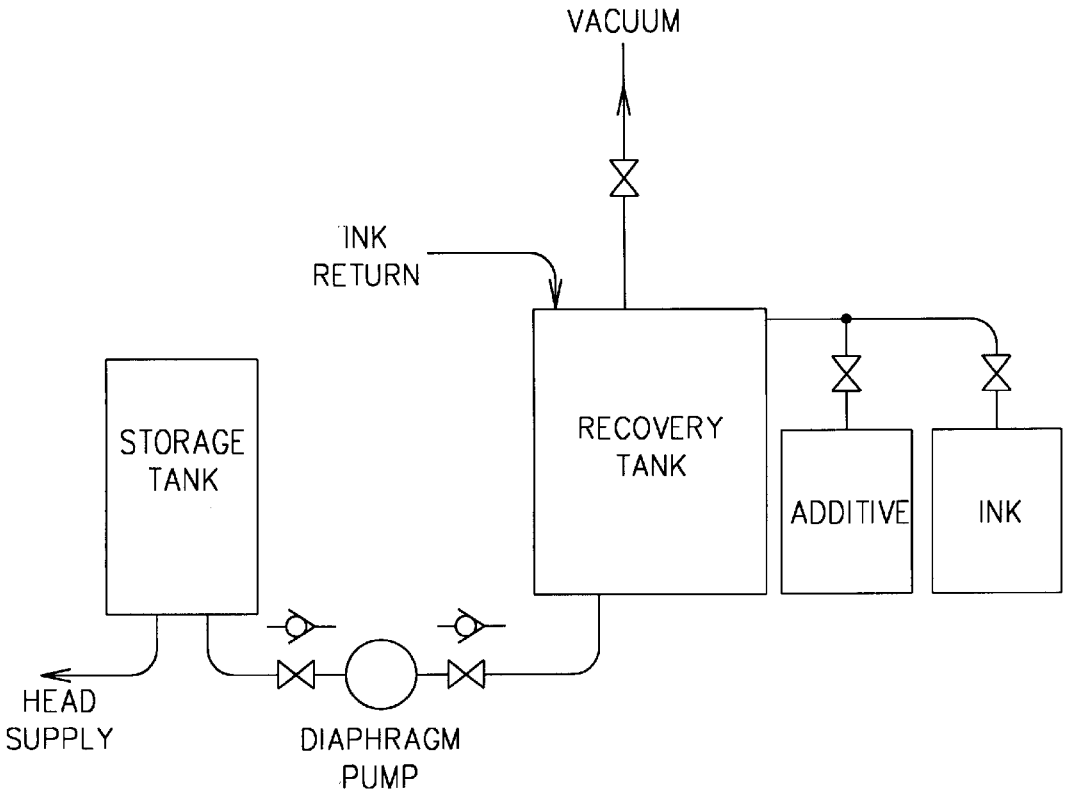
FIG. 2 PRIOR ART
Figure 3:
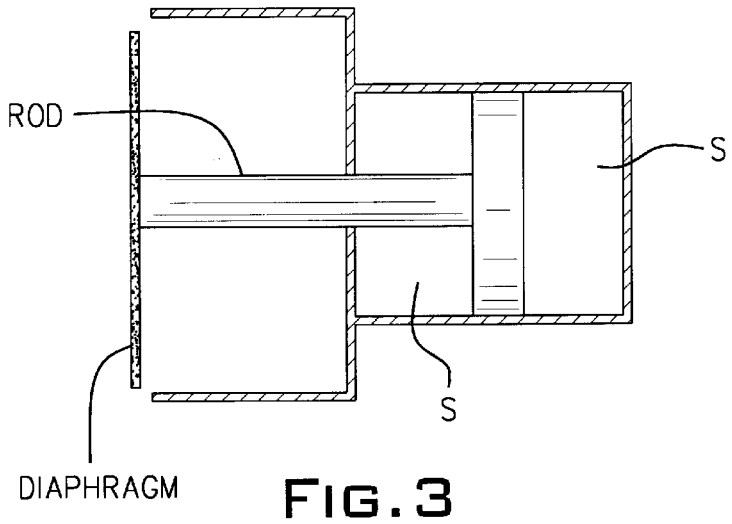
FIG. 3 shows the surfaces used in calculating the forces involved during an inventive pump delivery cycle.
Figure 4:
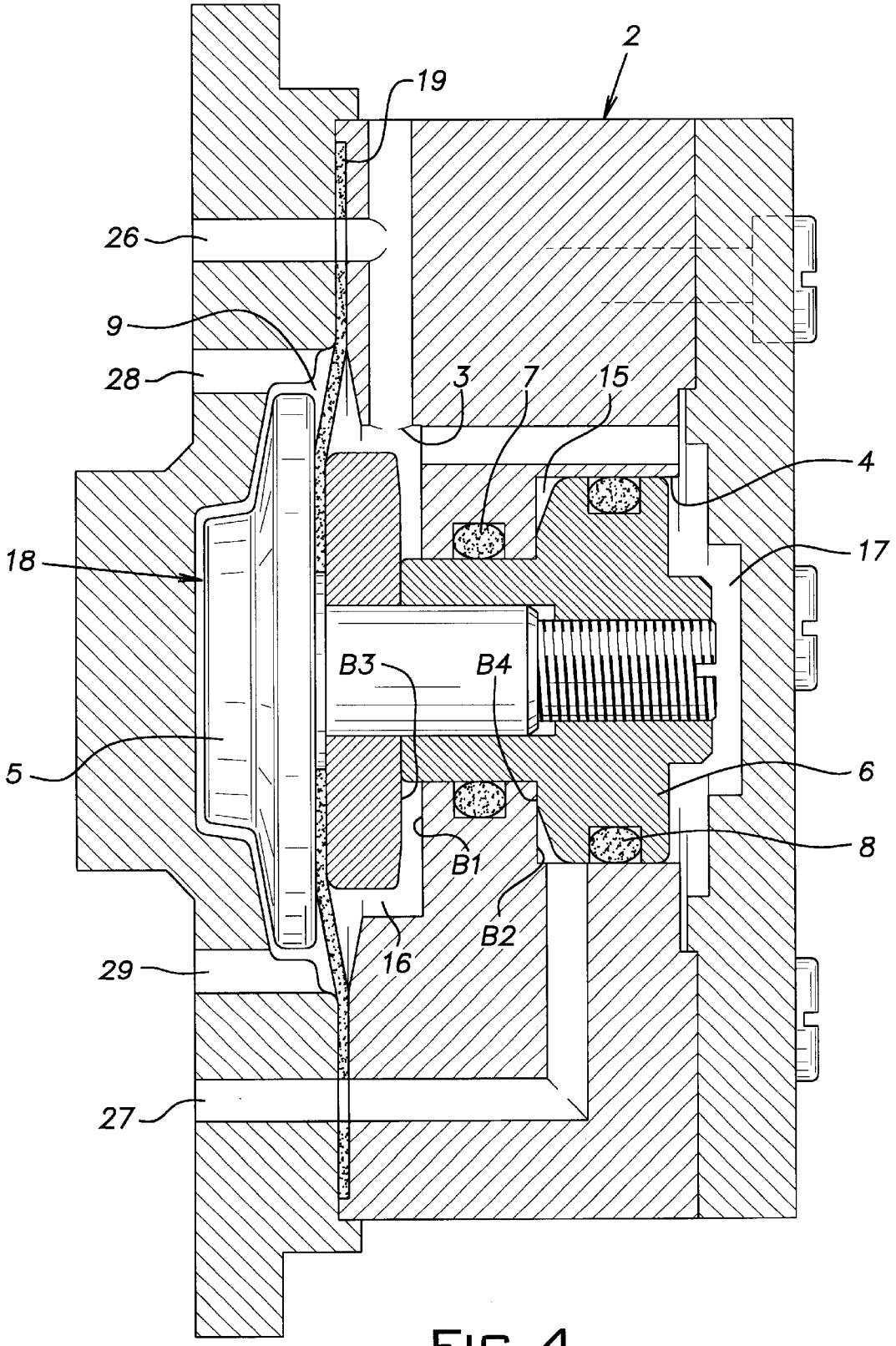
FIG. 4 illustrates the diaphragm pump according to the invention.
Figure 5:
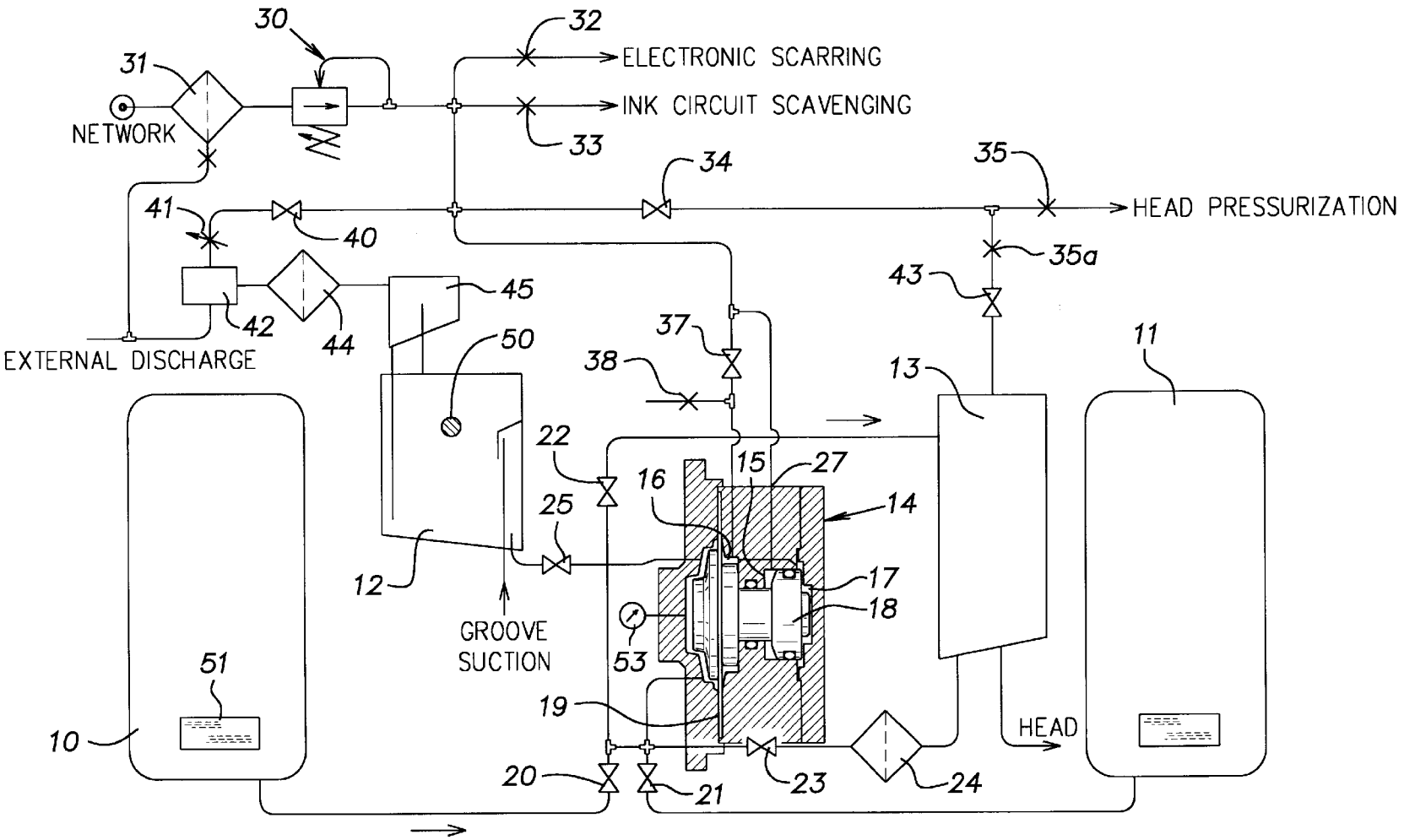
FIG. 5 illustrates the hydropneumatic diagram of an ink circuit using the pump of the invention.

The diaphragm pump according to the invention, as shown in FIGS. 4 and 5, is formed by a body 2 in which are hollowed out communication channels and two cavities 3, 4 in which are displaced the two parts 5, 6 of a piston 18, a diaphragm 19 being integral with a first 5 of said two parts. Two joints or seals 7, 8 are placed between the body 2 and piston 18, one seal 7 being integral with the body 2 and the other seal 8 integral with the second piston part 6. The positioning of the piston 18, equipped with the diaphragm 19 within said two cavities 3 and 4, makes it possible to implement a large chamber in two interconnected, isobaric parts 16 and 17, a small chamber 15, as well as an access chamber 9, to which give access respectively orifices 26, 27 and two suction/delivery orifices 28, 29 as shown in FIG. 4.

In the diaphragm pump according to the invention the embedding diameter on the piston 18 is defined so as to minimize the total, elastic deformation energy (Von Mises criterion). Moreover, the piston 18 has a support area for the diaphragm 19 used during the delivery sequence. This support area makes it possible to minimize diaphragm deformation. The diaphragm 19 can have a significant thickness, because the motive energy necessary for the movement is low (in fact as the diaphragm deformation energy is minimized, the energy necessary for moving it is small). It should also be noted that the pneumatic energy has no problems of torque and rotation speed stability (vibrations) such as can be encountered with an electric motor (particularly step motor). Thus the air control is much smoother.

The increase in the thickness of diaphragm 19 makes it possible to obtain an excellent pump life (exceeding three operating years in 2×8, 300 days per year on the basis of test results).

The internal shapes of the pump according to the invention remain simple, so as not to create difficultly cleanable retention areas.

An original feature of the pump according to the invention is its entirely pneumatic control mechanism. Delivery is obtained by pressurizing the diaphragm. Suction (admission) is also obtained by pressurizing a surface connected to the diaphragm.

Thus, the diaphragm is connected to a control jack (piston 18). This jack is a double acting jack for which the pressure is always present in the small chamber 15. When the other surfaces (diaphragm and large chamber of the jack) are left at atmospheric pressure, it is possible to ensure liquid suction. By pressurizing the diaphragm and the large jack chamber, delivery is possible.

The small jack chamber 15 is permanently connected to the source pressure and a single two-way/two-position solenoid valve is sufficient for pressurizing the other surfaces, in order to create jack displacement and consequently pumping.

The travel of such a pump is associated with the difference between two geometrical dimensions. The first dimension separates the faces B3 and B4 of part 6 and the second dimension separates the faces B1 and B2 of part 2 (cf. FIG. 4). The reproducibility of said dimension is very good and is only dependent on the construction quality of part 2 and part 6 (by moulding or machining). This reproducibility of the travel makes it possible to obtain pumps with an identical displacement (volume displaced for each pump stroke). For an ink jet printer it is then possible to use the pump as a flowmeter and e.g. measure the ink and solvent consumptions, as well as the jet flow rate.

With such a pump, the choice of a short travel (approximately 1 mm) offers a number of interesting points:

The deformation of the diaphragm and the deformation energy remain low. This feature is very important and makes it possible to obtain a diaphragm life compatible with several years of use of an ink jet printer.

The seals associated with the control jack can consequently be very easily implemented. Two standard O-rings (seals 7 and 8 in FIG. 4) make it possible to ensure the sealing functionality with additionally two vital advantages:

a) In the relative displacement of the piston with respect to part 2 (cf. FIG. 4), the movement takes place virtually without friction. As displacement is small, the seal deforms and rolls in its recess without any friction. There is virtually no seal wear and the force necessary for displacing the jack is negligible compared with the pressures used. The seal life exceeds 50 million manipulations on the basis of test results.

b) The cost of the sealing functionality is low, due to the use of standard elements used en masse in a majority of pneumatic components.

To summarize, the jack sealing functionality for such a pump is simple, inexpensive and has a very long life.

For use on an ink jet printer, the materials in contact with the ink are chosen as a function of their chemical compatibility with the fluids (ink, solvent). Thus, a stainless steel spindle 5 and a Teflon diaphragm 19 (e.g. 0.5 mm thick) are well suited to use on an ink jet printer. Moulding of the diaphragm on the spindle is possible and was carried out for testing purposes.

In an exemplified embodiment, the pump according to the invention 14 is used in an ink circuit, as shown in FIG. 5. The latter comprises an ink cartridge 10, an additive cartridge 11, a recovery tank 12 and a storage tank 13, each of these different components being connected to the pump according to the invention 14, which permits an ink transfer, air filters 31, 44, an ink filter 24, a pressure regulator 30, a condenser 45 and its radiator or heater, connecting channels on which are placed solenoid valves 20, 21, 22, 23, 25, 34, 37, 40, 43 and an electronic control card for these different components.

The bottom parts of the ink cartridge 10, additive cartridge 11 and the upper and lower parts of the storage tank 13 are connected to the same suction/delivery orifice of the pump 14 respectively via solenoid valves 20, 21, 22 and 23. A so-called main filter 24 is placed between the bottom of the storage tank 13 and the solenoid valve 23. The bottom of the accumulator 13 is also connected to the ink projection or spraying head. The lower part of the recovery tank 12 is connected to a second delivery/suction orifice of the pump 14 via a solenoid valve 25.

The ink circuit also comprises a pressure regulator 30 connected at the inlet to the compressed air network (5–10 bars) through an air filter 31 and at the outlet to the electronic and ink circuit scavenging operations via two gauges orifices 32 and 33. The outlet of the pressure regulator 30 is also connected to:

the head pressurization via a solenoid valve 34 and gauged orifice 35, the storage tank 13 through a solenoid valve 34, a solenoid valve 43 and a gauged orifice 35a, the large chamber of the pump 14 and a decompression orifice 38 through a solenoid valve 37, the small chamber 15 of pump 14, an external discharge through a solenoid valve 40, a regulatable gauged orifice 41 and a venturi tube 42, the bottom of the filter 31 also being connected to said external discharge by means of a gauged orifice 46.

The upper part of the storage tank 13 is connected to the common point for the solenoid valve 34 and the gauged orifice 35 by a solenoid valve 43 via the gauged orifice 35*a*.

The upper part of the recovery tank 12 is connected to the venturi tube 42 via a filter 44 and a condenser 45 and its lower part to the ink droplet suction located at the base of the ink spraying head. A level sensor, e.g. a contactless detector 50, is fixed to the wall of the recovery tank 12. A temperature and pressure sensor 53 is located in pump 14.

The pressure at the outlet of the pressure regulator 30 slightly exceeds the pressure in the storage tank 13. The small chamber 15 of the pump is connected to the regulated pressure at the outlet of the pressure regulator 30 and the large chamber to the same pressure through the solenoid valve 37.

When the solenoid valve 37 is closed, the diaphragm 19 is "tightened", there is "suction" with respect to the liquid located on the other side (volume 9). The piston comes into rear abutment B1.

When the solenoid valve 37 is open, the large chamber 16, 17 is at a pressure slightly below that of the small chamber 15, due to the existence of the decompression orifice 38. The surface of the piston 18 to which is applied the pressure of the large chamber 16, 17 is much larger than that to which is applied the pressure of the small chamber 15. Thus, as shown in FIG. 4, the piston comes into front abutment B2 and "delivery" occurs.

Piston 18 operates conventionally using the decompression orifice 38. When suction is desired, the system "deflates" through said orifice 38 and the diaphragm never abuts. Air compressibility makes it possible to obtain a flexible movement in particular preventing water hammer and impact phenomena. Thus, the life of the diaphragm 19 is improved compared with the above-described, prior art device.

The storage tank 13 permits a double regulation:

In Normal Operation

The solenoid valve 43 is closed.

Ink is introduced all at once into the storage tank 13 which has, due to its air pocket located in its upper part, a hydraulic, antipulsatory function making it possible to level out the flow curve. The dimensions of the volumes of the chamber of pump 14 and the air pocket of storage tank 13 are such that the instantaneous addition of a pump volume to the storage tank does not significantly modify the pressure of said storage tank. Typically, a ratio of 200 between the air pocket volume and the pump chamber volume is an acceptable lower limit. Taking account of this ratio of 200 and the geometry of the storage tank (at least $80^3$ cm air in the upper part), a pump displacement of 0.4 $cm^3$ is very suitable for a use of such a pump for an ink jet printer, The pressure is permanently measured with the aid of the sensor 53.

An elementary ink addition takes place with the aid of the pump 14 in order to cyclically replace the ink consumed by the jet. For standard use (a single nozzle of diameter 72 microns), the elementary ink addition takes place about every 6 seconds (10 strokes per minute).

When the Ink Cartridge 10 and Recovery Tank 12 are Empty

Passage no longer takes place via the pump 14 and the pressure is checked with the aid of the sensor 53.

In view of the fact that it is no longer possible to add ink, because the cartridge 10 and recovery tank 12 are empty, the storage tank empties gently and smoothly and the pressure therein tends to decrease. In addition, as the solenoid valve 34 is open, solenoid valve 43 is intermittently opened during very short times, which makes it possible to maintain the pressure in the storage tank 13. The necessary amount of air to compensate the liquid volume loss is added.

Fluid transferred between the different volumes take place by means of the pump of the invention 14 located in the centre of the circuit. Said pump 14 serves as a "switching yard" and is equipped with a pressure sensor 53. To the sensor has been added the temperature measurement functionality so as to be able to more correctly control the ink quality (measurement of the ink temperature in the core of the system). The double pressure/temperature measurement takes place by direct contact of the fluid within the pump with the sensitive element of the sensor. The pressure/temperature sensor is truly integrated into the pump with no pump/sensor separation.

The only operating condition for the pump 14 is that the pressure at the outlet of the regulator 30 exceeds the operating pressure. It is therefore merely necessary to regulate the pressure at the outlet of the regulator 30 with a safety margin with respect to the operating pressure (e.g. +500 mbar) in order to be able to remove any malfunctioning risk on the part of the system. From the industrial standpoint, this is an enormous advantage because all the machines of a printer range can be equipped with a single pump type. The pump 14 behaves like an element which self-adapts to the operating conditions.

Thus, for an ink circuit, the only difference for the pump between the different machines of a range is the pump use level. There is a use level of approximately three strokes per minute for a head of a first type P and approximately fifty strokes per minute for a head incorporating four jets of a second type G or eight jets of a third type M. The operating margin for such a pump remains high, because laboratory tests performed on prototypes have revealed a use level of 120 strokes per minute without any difficulty arising. It should also be noted that the operation of the pump does not influence the venturi tube recovery capacity. Thus, as the volumes 16 and 17 are small and the control solenoid valve 37 is flanged to the pump, there are only small pressure variations at the outlet of the regulator 30. These variations remain small when the regulator 30 has small dimensions. Thus, a choice is made of a small regulator (e.g. the smallest of the pneumatic range, i.e. approximately 6 Nm /h) with a very small vessel volume and a small passage diameter (approximately 3 mm).

As a result of particular cycles, said pump 14 permits the monitoring of certain elements of the circuit, so that it is possible to:

check the source pressure (pressure at the outlet of regulator 30): as the pump is in abutment at the end of the suction cycle (piston on face B1, cf. FIG. 4), the solenoid valves 20, 21, 22, 23, 25 being closed, solenoid valve 37 is then opened and the measurement of the sensor 53 then gives the source pressure value, check the clogging level of the filter 24: measurement takes place of the work necessary for the pump 14 for transferring its displacement through the filter. The measurement of this transfer work is associated with the calculation involving dynamic pressures. Thus, this work represents the difficulty for the pump to deliver through the filter is an information which can be found in the pressure diagram as a function of time.

Figure 6:
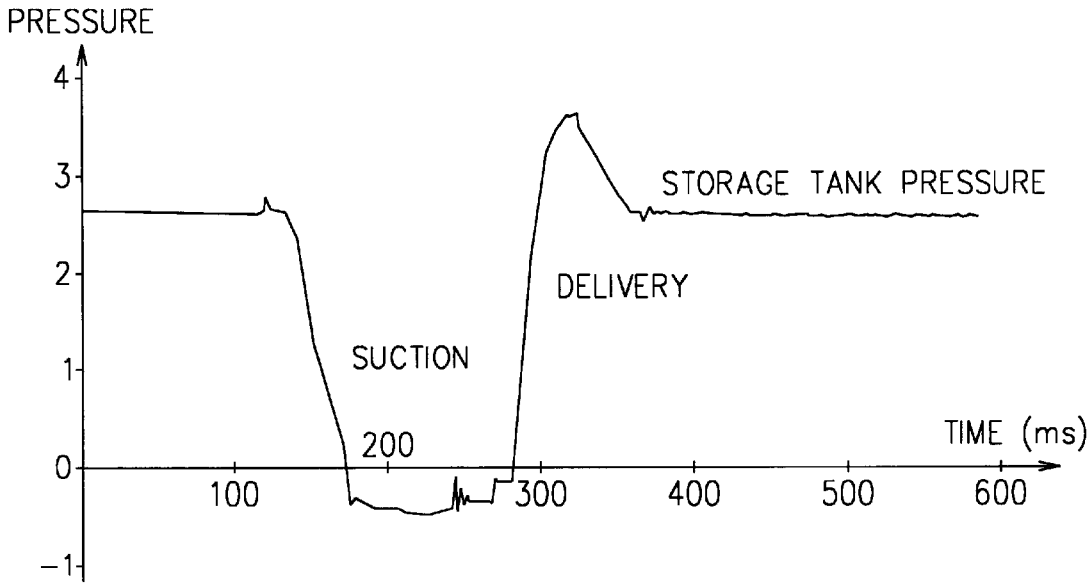
FIGS. 6 and 7 correspond to the pressure signal of the pump in a typical suction/delivery cycle.
Figure 7:
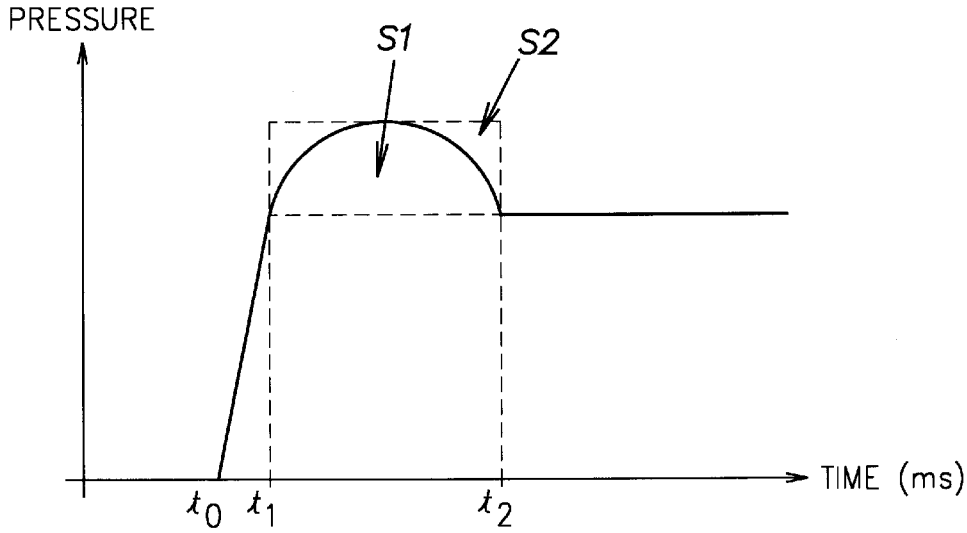

The configuration of the pressure signal during the transfer phase is illustrated in FIG. 7 (the integrality of a suction/delivery cycle being given in FIG. 6).

The decanting work is given by the surface S1 on the pressure/time graph. From the mathematical standpoint, the precise calculation of said surface is given by the integral:

$$\int_{t1}^{t2} (\text{pressure-accumulator pressure}) \cdot dt$$

It should be noted:

that the time $t_0$ (opening of the accumulator solenoid valve) is very close to the time $t_1$ (equilibrium of the pump and accumulator pressures), that the exact surface S1 can be approached by the surface S2.

The surface of S2 can be easily calculated and is:

$$(t_2-t_1)*(P\ \max-P\ \text{accumulator})$$

Through the coincidence of times $t_1$ and $t_0$, the clogging of the filter is finally found in the term $(t_2-t_0)$*(P max−P accumulator).

The calculation of this term and its comparison with a limit make it possible to fix an acceptable clogging level for the filter prior to its change. Moreover, an alert value informs the user of the need to change the filter in the near future.

Another functionality of such a pump is its capacity to check seals. For an ink jet application, the pump is the central element of the circuit. This particular position associated with the presence of a pressure sensor makes it possible to monitor all the components adjacent to the pump, so that it is possible to check:

The sealing of the solenoid valve 43: with the storage tank at a pressure close to atmospheric pressure and all the solenoid valves closed, solenoid valves 34 and 23 are opened. The pressure read off by the sensor must then remain constant. If the pressure evolves (increases), then solenoid valve 43 has a sealing defect.

The sealing of the storage tank: after checking the sealing of the solenoid valve 43, the latter is opened in order to pressurize the storage tank. Following an inflation time lag of a few seconds, solenoid valve 43 is closed. The pressure read off by the sensor must then remain constant. If the pressure evolves (decreases), then the storage tank 13 has a sealing defect.

The sealing of the solenoid valves 22 and 23 of the pump: after checking the seals of solenoid valve 43 and storage tank 13, solenoid valve 23 is closed and solenoid valve 25 opened. After a waiting time delay of a few seconds, solenoid valve 25 is closed and solenoid valve 23 opened. The pressure read off by the sensor must then be identical to that measured during the storage tank seal checking phase. If the pressure has evolved (decreased), then solenoid valve 23 or 22 (or both) have a sealing defect.

The sealing of solenoid valve 25, 20 and 21 of the pump: after checking the seals of solenoid valves 43, 23 and 24 and storage tank 13, solenoid valve 23 is closed. The pressure read off by the sensor must then remain constant at the storage tank pressure value. If the pressure evolves (decreases, then solenoid valve 25 and/or solenoid valve 21 and/or solenoid valve 23 have a sealing defect.

The sealing of solenoid valve 40: when the storage tank is at a pressure close to atmospheric pressure and all the solenoid valves are closed, solenoid valve 25 is opened. The pressure signal must then have a value close to atmospheric pressure. If the value read off by the sensor is lower than that of atmospheric pressure, then the solenoid valve 40 has a sealing defect and supplies the venturi tube.

What is claimed is:

1. A diaphragm pump, comprising:

a body, having a first cavity and a second cavity;

a control piston, having a first part in the first cavity, and a second part in the second cavity;

said control piston containing a diaphragm being integral with the first of the two piston parts;

two seals positioned between the body and the piston, one seal being integral with the first piston part and the other being integral with the second piston part;

the positioning of the first part of the piston within said first cavity providing a first chamber in two isobaric parts and an access chamber;

the positioning of the second part of the piston within said second cavity providing a second chamber, wherein the second chamber is smaller than the first chamber;

two communication channels, the first communication channel connected to the first chamber, and the second communication channel connected to the second chamber, wherein the piston drive stroke is powered by connecting both communication channels to a source of positive pressure whereas the piston return stroke is powered by reducing the pressure provided to the communication channel connected to the first chamber; and two suction/delivery orifices providing access to said access chamber.

2. Diaphragm pump according to claim 1, further comprising a single two-way/two-position solenoid valve completed by the presence of a gauged orifice permitting the depressurization of the chambers (16, 17).

3. Diaphragm pump according to claim 1, equipped with a pressure and temperature sensor (53), which is in direct contact with the fluid within the pump (14).

4. Hydraulic circuit equipped with the diaphragm pump according to any one of the claims 1, 2, or 3.

5. Hydraulic circuit according to claim 4 having means for monitoring the source pressure located at the outlet of the regulator (30).

6. Hydraulic circuit according to claim 4 having means for determining the clogging of a filter (24) located at its delivery.

7. Hydraulic circuit according to claim 4 having means for checking the seal of components of said circuit.

8. Hydraulic circuit according to claim 4 having means for implementing the flowmeter functionality of different consumed fluid quantities.

9. Ink jet printer equipped with an ink circuit according to claim 4.

* * * * *